US005909951A

United States Patent [19]

Johnsen et al.

[11] Patent Number: 5,909,951

[45] Date of Patent: Jun. 8, 1999

[54] OPTICAL CARTRIDGE

[76] Inventors: Audun Johnsen, Karlstadvn. 26, 2040 Kløfta; Ola Ro, Våglivn. 30, 1914 Ytre Enebakk, both of Norway; Jon Arne Schiefloe, Pestalozzi Strasse 54, D-1000 Berlin, Germany

[21] Appl. No.: 08/676,114

[22] PCT Filed: Jan. 10, 1995

[86] PCT No.: PCT/NO95/00009

§ 371 Date: Sep. 20, 1996

§ 102(e) Date: Sep. 20, 1996

[87] PCT Pub. No.: WO95/18949

PCT Pub. Date: Jul. 13, 1995

[30] Foreign Application Priority Data

Jan. 11, 1994 [NO] Norway ..... 940105

[51] Int. Cl.[6] ..... F41G 1/34

[52] U.S. Cl. ..... 362/111; 362/113; 362/259; 42/103

[58] Field of Search ..... 362/111, 113, 362/259, 191, 206; 42/103

[56] References Cited

U.S. PATENT DOCUMENTS

| | | | |
|---|---|---|---|
| 2,442,748 | 6/1948 | Blood et al. . | |
| 3,471,945 | 10/1969 | Fleury . | |
| 3,633,285 | 1/1972 | Sensney . | |
| 4,054,290 | 10/1977 | Villa . | |
| 4,152,754 | 5/1979 | DeFilippis et al. | 362/113 |
| 4,481,561 | 11/1984 | Lanning . | |
| 4,830,617 | 5/1989 | Hancox et al. | 362/111 |
| 5,355,608 | 10/1994 | Teetzel | 362/113 |
| 5,488,795 | 2/1996 | Sweat | 42/103 |
| 5,685,106 | 11/1997 | Shoham | 42/103 |

FOREIGN PATENT DOCUMENTS

| | | |
|---|---|---|
| 0467090 | 6/1991 | European Pat. Off. . |
| 3419985 | 5/1984 | Germany . |

*Primary Examiner*—Thomas M. Sember
*Attorney, Agent, or Firm*—Rothwell, Figg, Ernst & Kurz

[57] ABSTRACT

An optical cartridge adapted to be used in a weapon for emission of a light signal when the weapon is fired, which cartridge includes at least one battery; a light source adapted to be energized by said battery(ies) so that a visible or an invisible light beam will be emitted; a lens system; a firing switch adapted to be operated by a trigger acting on the weapon; and control circuits which represent the required interface between the battery(ies) and the light source. The cartridge in addition includes a loading switch adapted to energize the light source to emit an alignment light beam as long as the weapon is loaded with the cartridge. The main advantage of the invention is that the shooter will obtain detailed feedback relating to the quality of the aiming process.

11 Claims, 3 Drawing Sheets

OPTICAL CARTRIDGE

Figure 1:
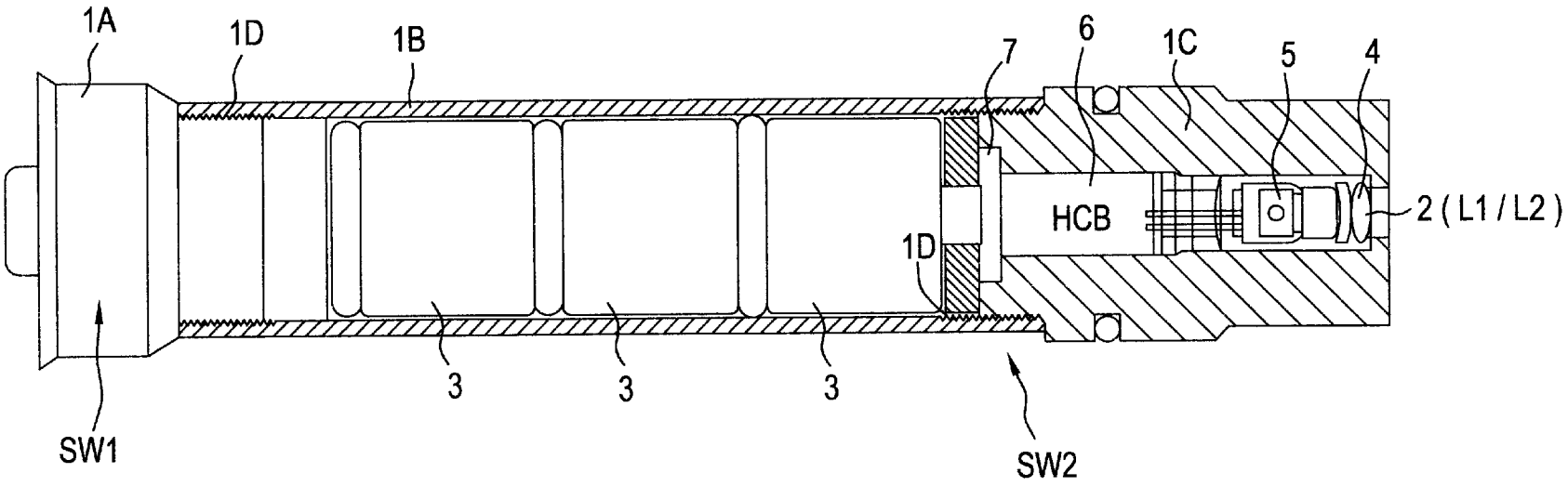

The present invention relates to an optical cartridge adapted to be used in a regular, not-modified weapon to emit a light beam instead of a real projectile. In particular the invention relates to an autonomous optical cartridge for emission of a light signal when the weapon is fired, which cartridge includes at least one battery; a light source adapted to be energized by said battery(ies) so that a visible or an invisible light beam will be emitted; a firing switch adapted to be operated by a trigger acting on the weapon; and control circuits which represent a required interface between the battery(ies) and the light source.

Optical cartridges of the type described above is earlier known e.g. from U.S. Pat. No. 3,471,945 (G. K. Fleury) and a similar solution is also shown in German patent publication DE No.: 34 19 985 A1.

From these publications optical cartridges adapted to be placed in an ordinary weapon and also adapted to emit a light beam when the weapon is triggered, is earlier known. These patents in particular relate to cartridges in which the light beam is delayed a certain period of time to compensate the differences in travelling time between the rather slow projectile and the quite immediately acting light beam. The cartridge according to the be application is also developed to be used together with an optical shooting simulator.

However, all earlier known optical cartridges emit a light beam only when the trigger is operated. Therefore the earlier known light emitting cartridges are not able to show the aiming point movements before and after the shooting moment. The known light emitting cartridges are only active during the shot itself. If a simulator shall give valuable information to the shooter about how to behave to obtain better shooting results in a real shooting situation, the new features of the present invention are of great importance.

Thus the main object of the present invention is to provide a new, optical cartridge for shooting simulators, which cartridge emits an alignment signal or alignment beam at least during parts of the aiming process, so that the shooter also may obtain detailed information of the aiming process, not only the shooting process. In a preferred embodiment the cartridge also exits a specific firing signal when a shot is released, and this firing signal may comprise the alignment signal having an additional signal superimposed thereon, or the firing signal may correspond closely to the alignment signal, but may have e.g. a different frequency. More generally any signal parameter may be changed as long as the firing signal is distinguishable from the alignment signal.

These objects are met by using an optical cartridge designed according to the principles stated in the claims below.

The cartridge according to the present invention in addition to the earlier known elements includes:

- a loading switch adapted to energize the light source as soon as the weapon is loaded with said cartridge, to emit an alignment light signal, and
- a control circuit which is adapted to change the energizing mode of said light source at the firing moment and intitiated by the operation of the trigger, so that a firing light signal having a different and distinguishable mode is emitted.

To obtain this the cartridge 1 is connected to the control circuit in such a manner that said circuit 6 first will be energized as the loading switch SW1 is closed to emit a first alignment signal L1, then at the firing moment $T_0$ initiated by the operation of the firing switch SW2, the cartridge 1 will emit a changed and detectable firing signal L2, and after a predetermined shot duration, only the alignment signal L1 will again be emitted until the loading switch SW1 is opened as the weapon is unloaded.

By constructing the optical cartridge in such a manner that it will emit a light beam of specific characteristics as soon as the cartridge is properly loaded into the weapon, it is obtained a new and valuable component for shooting simulators as this feature allows detection of the aiming point of the weapons barrel as well before as after the shooting.

Figure 2:
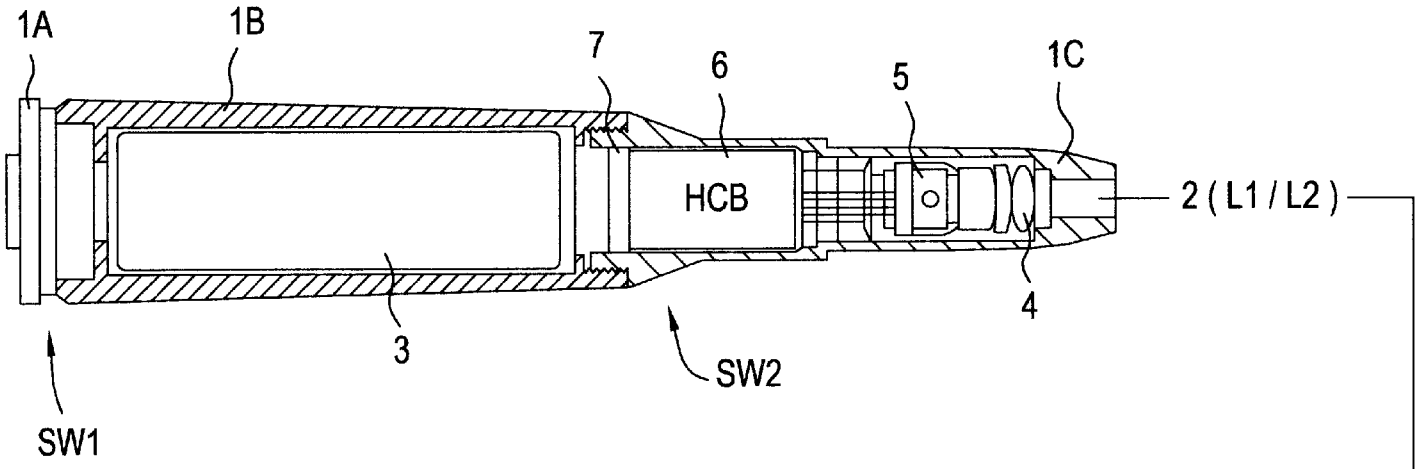
Figure 4:
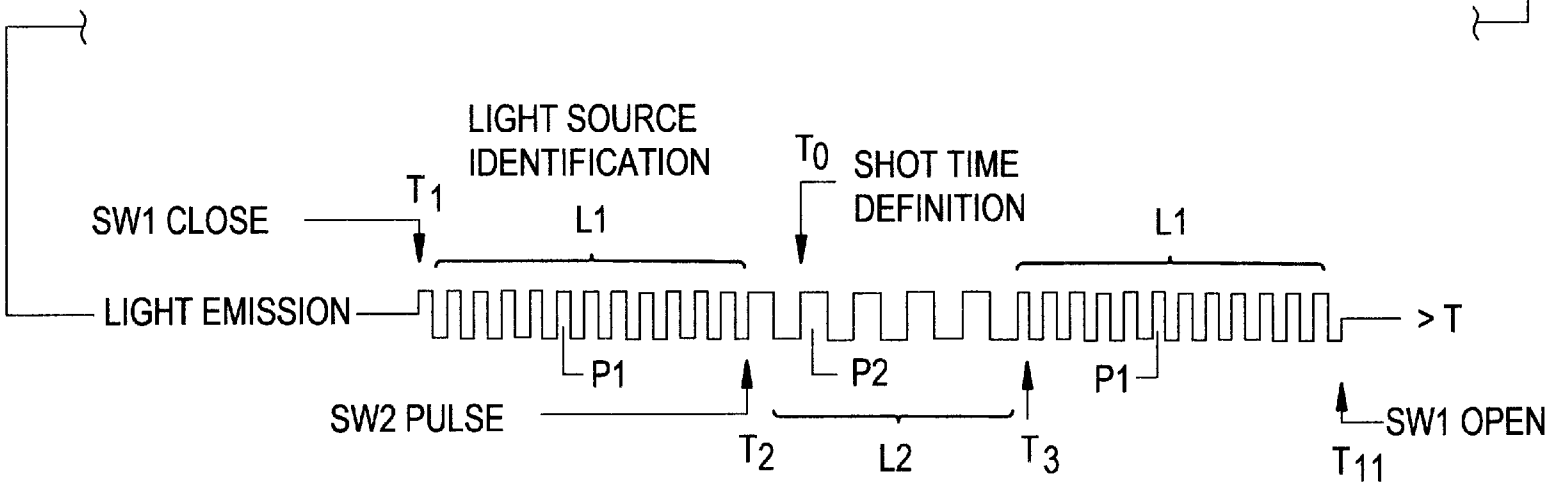
Figure 3:
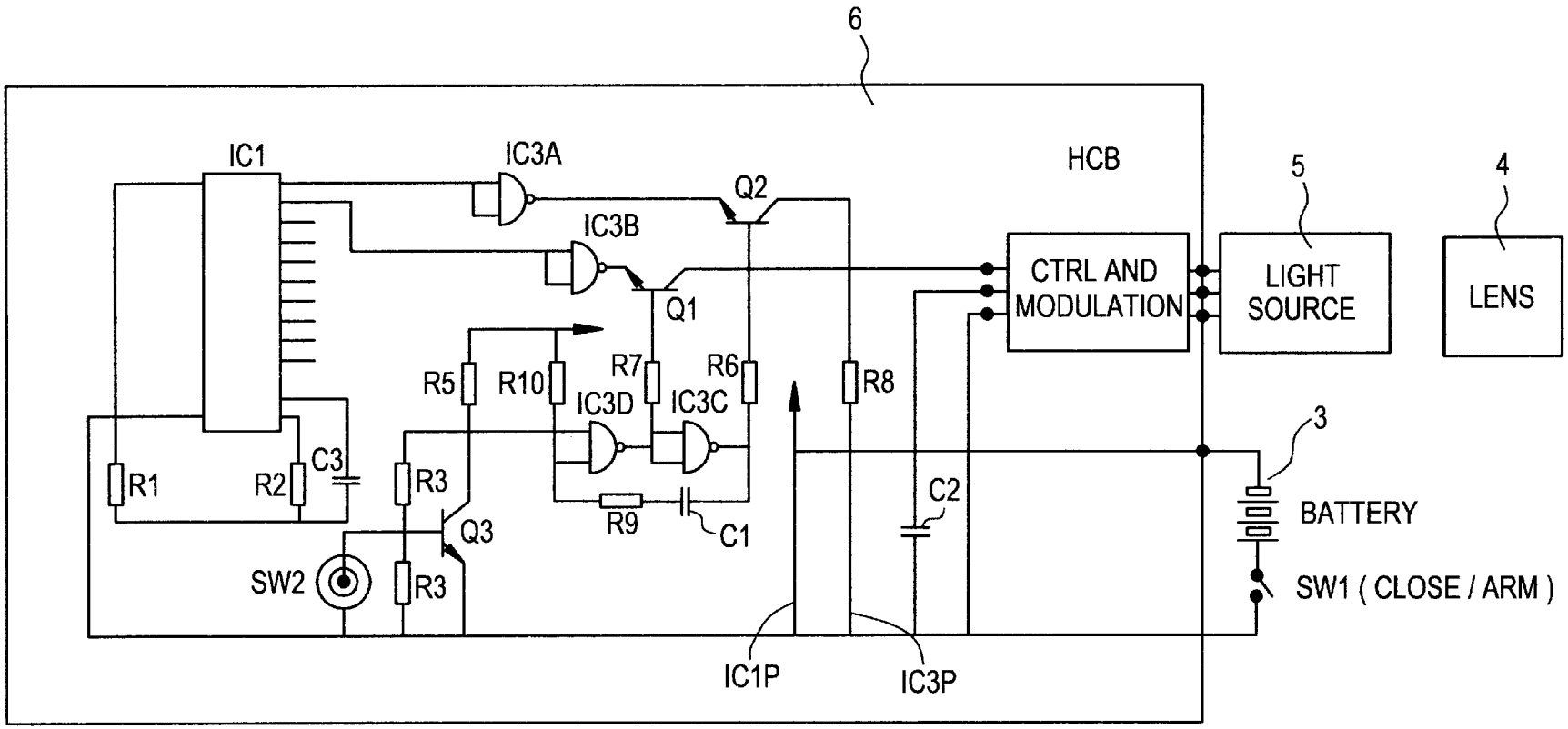

To give a better understanding of the present invention it is also referred to the detailed description below, and to the accompanying drawings in which:

FIG. 1 shows a cross sectional view of an optical cartridge adapted for shot gun applications and designed according to the present invention, FIG. 2 shows an optical cartridge adapted for rifle shooting application, this also according to the present invention, FIG. 3 shows a possible circuit diagram for the control circuit of the cartridge according to the present invention using digital integrated PCB design, and FIG. 4 shows as an example a possible waveform for a light signal from an optical cartridge according to any of the FIGS. 1–3.

In the description which follows, like parts are marked throughout the specification and drawings with the same reference numerals, respectively. The figures of the drawings are not all necessarily to the save scale and certain features may be shown exaggerated in scale or in a somewhat scematic form.

In FIG. 1 the cartridge 1 which is designed for use in a shot gun, is enveloped in a metalic housing consisting of three parts, viz. the base portion 1A, the central portion 1B, and the top portion 1C. These three portions are assembled securely, e.g. by the threaded portions 1D. The cartridge 1 has when assembled, a similar shape and size as a regular shot gun cartridge. The energy source, i.e. the batteries 3, are located in the central portion 1B, the light source 5, preferably a laser, is located in the top portion 1C while the control circuit 6 preferably is arranged an a printed circuit board HCB arranged close to or just within the foremost threaded portion 1D. The cartridge 1 in addition includes a focusing lens system 4, a loading switch SW1 and a firing switch SW2. In the shown embodiment the switch SW1 is an ordinary, mechanically operated micro-switch located centrally on the end face of the base portion 1A, while the firing switch SW2 is an acoustically operated switch arranged totally encapsulated in the top portion 1C, close to the foremost threaded portion 1D. When the cartridge is active, and so it will always be when properly loaded into the weapon, a light beat 2 of visible or invisible light will be emitted constantly, i.e. not only when a shot is released.

In FIG. 2 a similar cartridge 1 designed for a rifle is shown. Here only one battery 3 is required, and this cartridge is much smaller as it is designed to fit snugly into the cartridge chamber of an ordinary rifle. Otherwise the functional details are just the same as described in connection with FIG. 1. As indicated in this drawing two different light beams may be emitted. The alignment light beam referred to as L1 is emitted as soon as the weapon is loaded, while the firing light beam L2 first is emitted when the trigger is activated and thus simulates the shot.

In a preferred embodiment the control circuit 6 is designed as a digital electronic circuit comprising standard integrated circuits and electronic components. When a laser 5 is used as the light source all these circuits may be delivered by the laser supplier from stock, and therefore the details are not explained. The details of the circuitry are not critical, but on FIG. 3 a possible circuit diagram is shown as an example. Here the output signals (L1) and (L2) arranged in brackets, only are meant to symbolize the signals required to change the transmitting node of the light source 5. Using a circuit as shown the light signal will have a waveform as shown in FIG. 4. An many alternative circuit designs are usable, the function of the shown circuitry is not explained in detail. It should however be mentioned that an analogue solution may be used as well, giving an output light signal of a sinusoidal character. And the small arrows shown in the circuit diagram of FIG. 4, are only symbols telling that the corresponding points of the diagram shall be interconnected.

Assuming again that the control circuit 6 or HCB is a digital one, the light signal may for instance obtain a square pulse shape as illustrated along the time axis t in the diagram of FIG. 4.

As soon as the weapon is properly loaded with said cartridge 1 at the time $T_1$, the loading switch SW1 will be closed, e.g. by mechanical depression, and it will remain closed until the weapon is again unloaded. The control and modulating circuit 7 of the light source 5 will then be activated, and a first alignment light signal L1 will be emitted. In the shown example this may be represented by a pulse train L1 consisting of periodic and repetitive square light pulses P1.

Once the firing switch SW2 is closed, initiated by the triggering process, the input signal applied to the light source control and modulating circuit 7 changes and as a result the laser 5 will now be modulated to emit a firing light signal L2 at its optical output, so that the light signal 2 is changed for a short, predetermined time period, e.g. by being converted into a firing light signal L2 having a reduced frequency as shown in FIG. 4. The modulated part L2 of the transmitted signal may take many different wave forms. In the FIG. 4 it is shown as an example that the frequency of the signal L2 has bean reduced to the half of that of L1. However, many other modulating techniques may be used as long as the change of the signal is detectable. A digital, detectable code may e.g. be superimposed on to the basic signal caused by closure of the firing switch SW2.

The duration of the modulated firing signal L2 may also be predetermined by the control circuit by ordinary time controlling circuitry.

A further detail of a certain importance is that the exact moment $T_0$ of the shot may be defined with some delay related to the triggering time $T_2$. The reason for this delay is both 1)—to ensure that short-lasting, transient changes, e.g. due to external disturbances, shall not erroneously be interpreted as shot-events, and 2)—to delay the definition of $T_0$ a short time interval $T_0$–$T_2$ corresponding to the time required for a real bullet to leave a real explosive cartridge.

It should be emphasized that the shown embodiments are examples of implementations only. Many alternative solutions and modifications are possible within the scope of the present invention. Thus the design of the two switches SW1 and SW2 may vary as all conventional and suitable switch designs may be chosen. Therefore the mentioned mechanical micro-switch and the acoustically operated switch are examples only. The loading switch SW1 may for instance include a magnetic device to ensure that the switch does not close if the cartridge 1 is not embedded in iron. And the firing switch SW2 may be a mechanically operated switch instead of an acoustically operated one. The light source 5 may be any light-emitting weans as long as it is interfaced correctly to the energy source 3.

We claim:

1. An optical cartridge for use in a weapon having a barrel and a firing chamber to emit light signals instead of a projectile through the barrel of the weapon when a trigger on the weapon is actuated, said optical cartridge comprising:

a casing configured to fit within the firing chamber of the weapon;

a light source and a focusing lens system disposed within said casing so as to emit a beam of non-visible light through the barrel of the weapon;

a power source which energizes said light source to emit said beam of light;

a control circuit which controls the energizing of said light source;

a first, loading switch connected to said power source, said loading switch being actuated at a time when the optical cartridge is loaded into the firing chamber of the weapon; and a second, firing switch connected to said control circuit, said firing switch being actuated at a time when said trigger is actuated;

said loading switch and said firing switch controlling operation of the optical cartridge such that 1) a first, alignment light beam is emitted by said light source from the time the optical cartridge is loaded into the firing chamber until the time the trigger is actuated; and 2) a second, firing light beam that is distinguishable from said alignment light beam is emitted by said light source from the time the trigger is actuated, or from a time shortly thereafter, for a predetermined length of time.

2. The optical cartridge as claimed in claim 1, wherein the loading switch is a micro-switch adapted to be operated automatically when the optical cartridge is loaded into the firing chamber of the weapon.

3. The optical cartridge as claimed in claim 1, wherein the control circuit causes a code signal to be superimposed onto the alignment light beam when the firing switch is actuated so that said light source emits said firing light beam.

4. The optical cartridge as claimed in claim 1, wherein the control circuit causes frequency, phase, and/or modulation of the alignment light beam to change when the firing switch is actuated so that said light source emits said firing light beam.

5. The optical cartridge as claimed in claim 1, wherein the firing switch is an acoustically actuated switch.

6. The optical cartridge as claimed in claim 1, wherein the loading switch is arranged in parallel with the firing switch.

7. The optical cartridge as claimed in claim 1, wherein the control circuit comprises digital circuitry disposed on a printed circuit board.

8. The optical cartridge as claimed in claim 1, wherein the control circuit includes a delay circuit which causes emission of said firing light beam to be delayed by a time interval extending from the time said firing switch is actuated until said time shortly thereafter, said time interval corresponding to an amount of time required for a live round of ammunition to ignite and fire a projectile, whereby said firing light beam is emitted by said light source at a time corresponding to a time at which the projectile would be fired by the live round of ammunition.

9. The optical cartridge as claimed in claim 1, wherein said light source comprises a laser, said firing light beam comprises a first pulsed train of square light pulses having a first frequency, and said alignment light beam comprises a second pulsed train of square light pulses having a second frequency.

10. The optical cartridge as claimed in claim 9, wherein said first frequency is one half of said second frequency.

11. The optical cartridge as claimed in claim 1, wherein a third, alignment beam of light is emitted by said light source after said predetermined length of time has elapsed, said third, alignment beam of light being identical to said first, alignment beam of light.

* * * * *

UNITED STATES PATENT AND TRADEMARK OFFICE

CERTIFICATE OF CORRECTION

PATENT NO. : 5,909,951

DATED : June 8, 1999

INVENTOR(S) : Audun JOHNSEN et al.

It is certified that error appears in the above-identified patent and that said Letters Patent are hereby corrected as shown below:

Col. 1, line 42, "exits" should be --emits--.

Col. 2, line 28, "save" should be --same--.

Col. 3, line 5, "node" should be --mode--.

Col. 3, line 66, "weans" should be --means--.

Signed and Sealed this

Thirtieth Day of May, 2000

*Attest:*

*Attesting Officer*

Q. TODD DICKINSON

*Director of Patents and Trademarks*